US007003979B1

(12) United States Patent
Davidson

(10) Patent No.: US 7,003,979 B1
(45) Date of Patent: Feb. 28, 2006

(54) METHOD AND APPARATUS FOR MAKING A SORBER

(75) Inventor: Howard Davidson, San Carlos, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 0 days.

(21) Appl. No.: 09/524,216

(22) Filed: Mar. 13, 2000

(51) Int. Cl.
*F25B 33/00* (2006.01)

(52) U.S. Cl. ..... 62/497; 62/480

(58) Field of Classification Search ..... 62/480, 62/497, 476, 101

See application file for complete search history.

(56) References Cited

U.S. PATENT DOCUMENTS

| | | | |
|---|---|---|---|
| 1,877,536 | A | 9/1932 | Ruckelshaus et al. |
| 1,881,568 | A | 10/1932 | Henney |

(Continued)

FOREIGN PATENT DOCUMENTS

| | | |
|---|---|---|
| DE | 436988 | 11/1926 |
| DE | 585880 | 10/1933 |
| DE | 41 13 042 | 10/1992 |
| EP | 0 037 643 | 10/1981 |
| EP | 0 091 382 | 10/1983 |
| FR | 1029877 | 12/1950 |
| FR | 2 604 100 | 3/1988 |
| FR | 2 651 621 | 3/1991 |
| FR | 2 666 141 | 2/1992 |
| FR | 2698098 | 11/1992 |
| FR | 2 689 220 | 10/1993 |
| FR | 2 703 763 | 10/1994 |
| FR | 2 736 421 | 1/1997 |
| WO | 94/11457 | 5/1994 |
| WO | 97/11323 | 3/1997 |

OTHER PUBLICATIONS

US 5,027,607, 7/1991, Rockenfeller et al. (withdrawn)

Iloeje, "Design Construction and Test Run of a Solar Powered Solid Absorption Refrigerator," Solar Energy, vol. 35, No. 5, pp. 447–455, 1985.

Buffington, "Absorption Refrigeration with Solid Absorbents," Sep. 1933, pp. 137–142, 152.

Vasiliev et al., "Waste Heat Driven Solid Sorption Coolers," pp. 1–9.

*Primary Examiner*—Henry Bennett
*Assistant Examiner*—Melvin Jones
(74) *Attorney, Agent, or Firm*—Meyertons Hood Kivlin Kowert & Goetzel, P.C.; B. Noël Kivlin

(57) ABSTRACT

A structure and method of manufacture for a sorber, wherein a mass of sorbent contained in a sorber enclosure comprises a plurality of sorbent disks stacked in face-to-face relation. The sorbent disks are formed from a solid sorbent material such as zeolite and contain surface features in at least one face of each disk which, when the disks are stacked, form passageways by which sorbate is distributed throughout the mass of sorbent material. In one embodiment, each sorbent disk is annular in shape and has a plurality of radial grooves which extend from the periphery of the disk to the aperture through the center of the disk. The disks are stacked face-to-face and an inner conductor is inserted through the center apertures of the disks. This assembly is then inserted into a conductive housing and is enclosed by a pair of end plugs or caps which are secured to the housing. A port in one of the end caps allows sorbate to enter and exit the sorber enclosure. The sorber structure forms a coaxial transmission line for electromagnetic waves which are used to desorb sorbate from the sorbent disks. Alternate embodiments may use sorbent disks which employ surface features other than grooves to provide passageways through the sorbent mass. Alternate embodiments may also have configurations which are not cylindrical and/or coaxial.

42 Claims, 8 Drawing Sheets

U.S. PATENT DOCUMENTS 2,138,685 A 11/1938 Altenkirch
2,326,130 A 8/1943 Erland af Kleen
2,338,712 A 1/1944 Erland af Kleen
2,384,460 A 9/1945 Erland af Kleen
2,496,459 A 2/1950 Erland af Kleen
2,624,182 A 1/1953 Gross
4,312,640 A 1/1982 Verrando
4,312,641 A 1/1982 Verrando et al.
4,399,341 A 8/1983 Yasouka
4,408,255 A 10/1983 Adkins
4,571,473 A 2/1986 Wyslouzil et al.
4,581,049 A 4/1986 Januschkowetz
4,742,868 A 5/1988 Mitani et al.
4,878,152 A 10/1989 Sauzade et al.
4,884,626 A 12/1989 Filipowski
4,889,965 A 12/1989 Gervais et al.
4,928,207 A 5/1990 Chrysler et al.
4,944,159 A 7/1990 Crozat
4,976,117 A 12/1990 Crozat et al.
5,021,620 A 6/1991 Inumada
5,025,635 A 6/1991 Rockenfeller et al.
5,088,302 A 2/1992 Tomizawa et al.
5,161,389 A 11/1992 Rockenfeller et al.
5,165,247 A 11/1992 Rockenfeller et al.
5,179,259 A 1/1993 Martin
5,184,470 A 2/1993 Moser et al.
5,186,020 A 2/1993 Rockenfeller et al.
RE34,259 E 5/1993 Rockenfeller
5,216,327 A 6/1993 Myers et al.
5,220,804 A 6/1993 Tilton et al.
5,222,543 A 6/1993 Carlstrom et al.
5,223,809 A 6/1993 Myer
5,227,598 A 7/1993 Woodmansee et al.
5,271,239 A 12/1993 Rockenfeller et al.
5,274,347 A 12/1993 Bobadilla
5,291,942 A 3/1994 Ryan
5,298,231 A 3/1994 Rockenfeller
5,300,901 A 4/1994 Krümmel et al.
5,328,671 A 7/1994 Rockenfeller
5,333,471 A 8/1994 Yamada
5,335,510 A 8/1994 Rockenfeller et al.
5,396,775 A 3/1995 Rockenfeller et al.
5,404,272 A 4/1995 Lebailly et al.
5,441,716 A 8/1995 Rockenfeller
5,442,931 A 8/1995 Ryan et al.
5,453,641 A 9/1995 Mundinger et al.
5,490,398 A 2/1996 Cline
5,522,452 A 6/1996 Mizuno et al.
5,535,817 A * 7/1996 Dunne ..... 165/104.12
5,604,978 A 2/1997 Sherif et al.
5,761,037 A 6/1998 Anderson et al.
5,823,005 A 10/1998 Alexander et al.
5,842,356 A 12/1998 Pfister et al.
5,855,119 A 1/1999 Pfister et al.
5,855,121 A 1/1999 Byrd et al.
5,873,258 A 2/1999 Pfister et al.
5,916,259 A 6/1999 Pfister et al.
5,992,168 A 11/1999 Pfister et al.
6,006,543 A 12/1999 Byrd et al.
6,032,476 A 3/2000 Pfister et al.
6,032,477 A 3/2000 Pfister et al.
6,038,878 A 3/2000 Pfister et al.
6,038,883 A 3/2000 Pfister et al.
6,044,661 A 4/2000 Pfister et al.

* cited by examiner

METHOD AND APPARATUS FOR MAKING A SORBER

BACKGROUND OF THE INVENTION

1. Field of the Invention

The present invention relates to sorption systems where a sorbate is alternately adsorbed onto and desorbed from a sorbent and more particularly an improved sorber structure and method for making such a sorber.

2. Description of Related Art

In a sorption system, a first substance called a sorbate is alternately adsorbed (or absorbed) onto a second substance called a sorbent and then desorbed (or removed) from the sorbent. If the sorbate is adsorbed onto the sorbent, the system may be referred to as an adsorption system. If the sorbate is absorbed onto the sorbent, the system may be referred to as an absorption system. Sorption systems are often used to effectively compress the sorbate. For example, sorption systems may be used in refrigeration units in place of a compressor.

During an adsorption reaction, the sorbate which is drawn onto the sorbent forms a sorbate/sorbent compound. In an absorption system, essentially the same process occurs, except that the sorbate merely adheres to the sorbent rather than forming a compound with it. The specific sorbate and sorbent used in a particular sorption system may be selected to provide desired characteristics which depend upon the affinity of the sorbent and sorbate. It is not necessary to supply any energy to the system in order for the adsorption reaction to proceed.

During a desorption reaction, energy is supplied to the compound to break the bonds of the compound and separate the sorbate from the sorbent. This energy may be supplied by heating the sorbate/sorbent compound, or by supplying energy in the form of electromagnetic waves which can break the bonds between the sorbate and sorbent without heating them. Typically, during the adsorption reaction, the sorbate is a low pressure gas. During the desorption reaction, the volume of the sorbate which is separated from the sorbent is constrained, and a high-pressure sorbate gas is produced.

The absorption and desorption reactions normally take place in a sorber. The sorber typically comprises a housing in which a mass of sorbent is located. Ports are provided in the housing to allow the sorbate to enter and exit the housing so that it can be adsorbed onto and desorbed from the sorbent. The sorber is also configured to operate in conjunction with the desorption means (e.g., heater or electromagnetic wave generator.)

While it is typically advantageous to have a compact sorber design, it is also advantageous to provide the greatest possible surface area between the sorbate and sorbent. Typically, these competing considerations are optimized by providing a solid mass of sorbent and drilling a large number of holes into the sorbent to provide channels through which the sorbate can flow. Thus, the sorbate does not have to penetrate the outer layer of the sorbent mass in order to react with the inner layers. It can, however, be relatively costly to drill these holes in the sorbent.

SUMMARY OF THE INVENTION

One or more of the problems of the problems of the prior art outlined above may be solved by the various embodiments of the present invention. Broadly speaking, the invention comprises an improved sorber structure and a related methods of manufacture.

One embodiment of the present apparatus is a sorber for use in a sorption cooling system. The sorber comprises a cylindrical housing configured to enclose a sorbent mass. The sorbent mass itself comprises a plurality of disks of the sorbent material, wherein each disk has a plurality of radial grooves formed in the surface thereof. The disks are stacked so that the grooves form channels which extend from the outer surface of the sorbent mass to its interior. The disks can be tightly fitted to the housing to provide an improved thermal path between the sorbent and the exterior of the sorber.

In one embodiment, the sorber is designed to be used in conjunction with an electromagnetic wave generator. The sorber has an inner conductor and an outer conductor which form a transmission line for electromagnetic waves produced by the generator. The electromagnetic waves are directed by the transmission line onto the sorbent material which lies between the inner and outer conductors. In order to increase the penetration of the electromagnetic waves into the sorbent and increase the magnitude of the electric field in the sorbent, metal disks are stacked alternately with the sorbent disks. Successive metal disks in the stack are sized to alternately contact the inner and outer conductors. The metal disks also serve to increase the thermal conductivity between the sorbent and the sorber's exterior.

Another embodiment of the present invention comprises a method for making a sorber. The method comprises forming a sorbent material into a plurality of annular disks. Each disk has a plurality of radial grooves in its surface so that when the disks are stacked together, the grooves form channels which extend from the perimeter of the stack to the interior of the stack. The stack of sorbent disks is placed in a sorber housing which comprises cylindrical inner and outer conductors. The inner conductor is placed in the hole formed by the annular apertures of the disks and the outer conductor encompasses the entire stack of disks. The conductors are tightly fitted against the disks by swaging them against the disks. The stack of disks may be formed with thin metal disks between adjacent sorbent disks. Successive metal disks are sized to alternately contact the inner and outer conductors to effectively form interleaved conductors. The sorber housing is sealed, except for one or more ports which allow sorbate to flow into and out of the sorber. The sorber housing also includes a window which is transparent to the electromagnetic waves so that an electromagnetic wave generator can be coupled to the sorber to desorb the sorbate.

BRIEF DESCRIPTION OF THE DRAWINGS

Other objects and advantages of the invention will become apparent upon reading the following detailed description and upon reference to the accompanying drawings in which.

Figure 1:
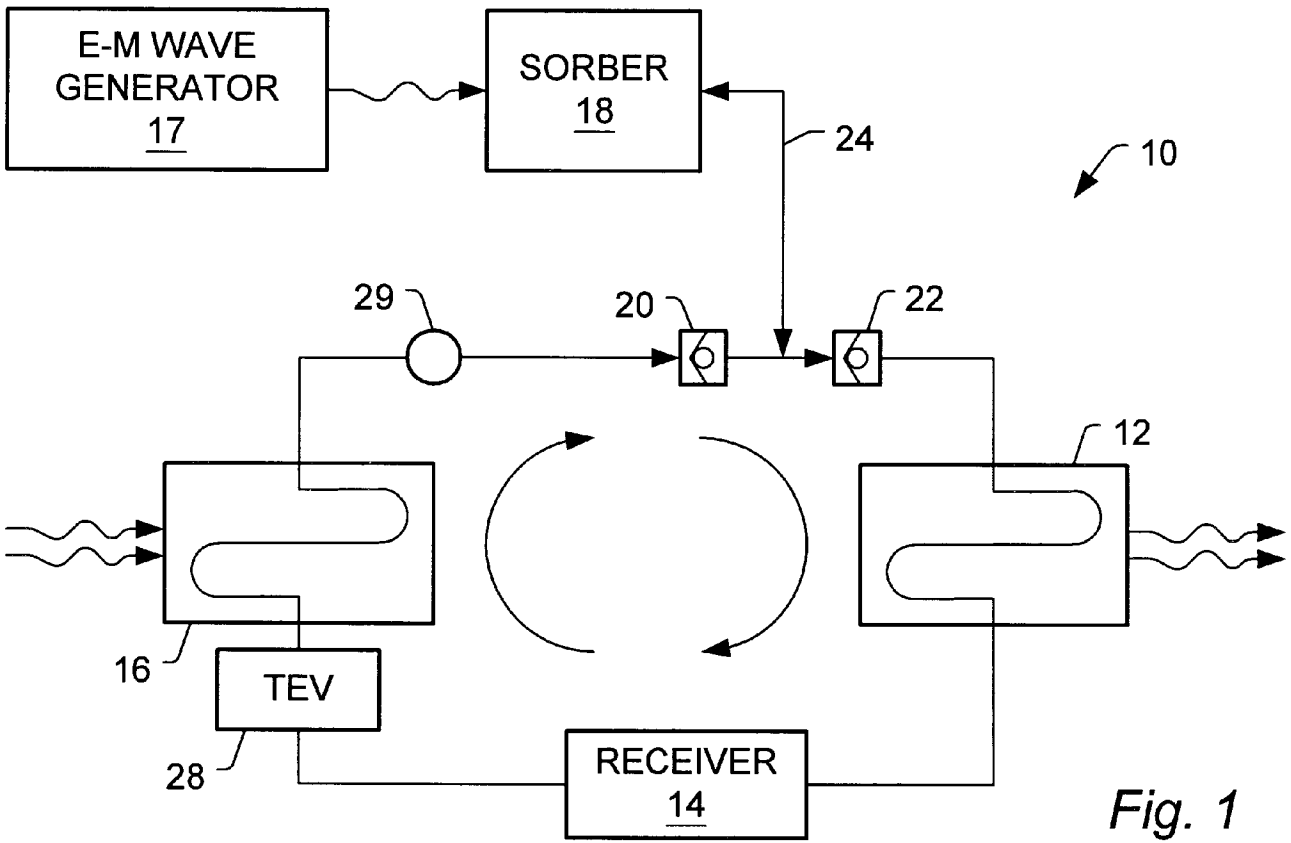
FIG. 1 is a block diagram of a sorption cooling system in accordance with one embodiment.

While the invention is susceptible to various modifications and alternative forms, specific embodiments thereof are shown by way of example in the drawings and will herein be described in detail. It should be understood, however, that the drawing and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

One embodiment of the invention is described below. In this embodiment, a sorber for use in a sorption cooling system comprises a sorber enclosure and a sorbent mass contained therein. The sorbent mass itself consists of a set of disks stacked together face-to-face. The disks are manufactured from a sorbent material and are formed with grooves or other surface features which, when the disks are stacked, provide passageways through which a sorbate can be transported to the interior of the sorbent mass. The amount of surface area of the sorbent which is exposed to the sorbate is thereby increased, resulting in improved adsorption characteristics.

Figure 11:
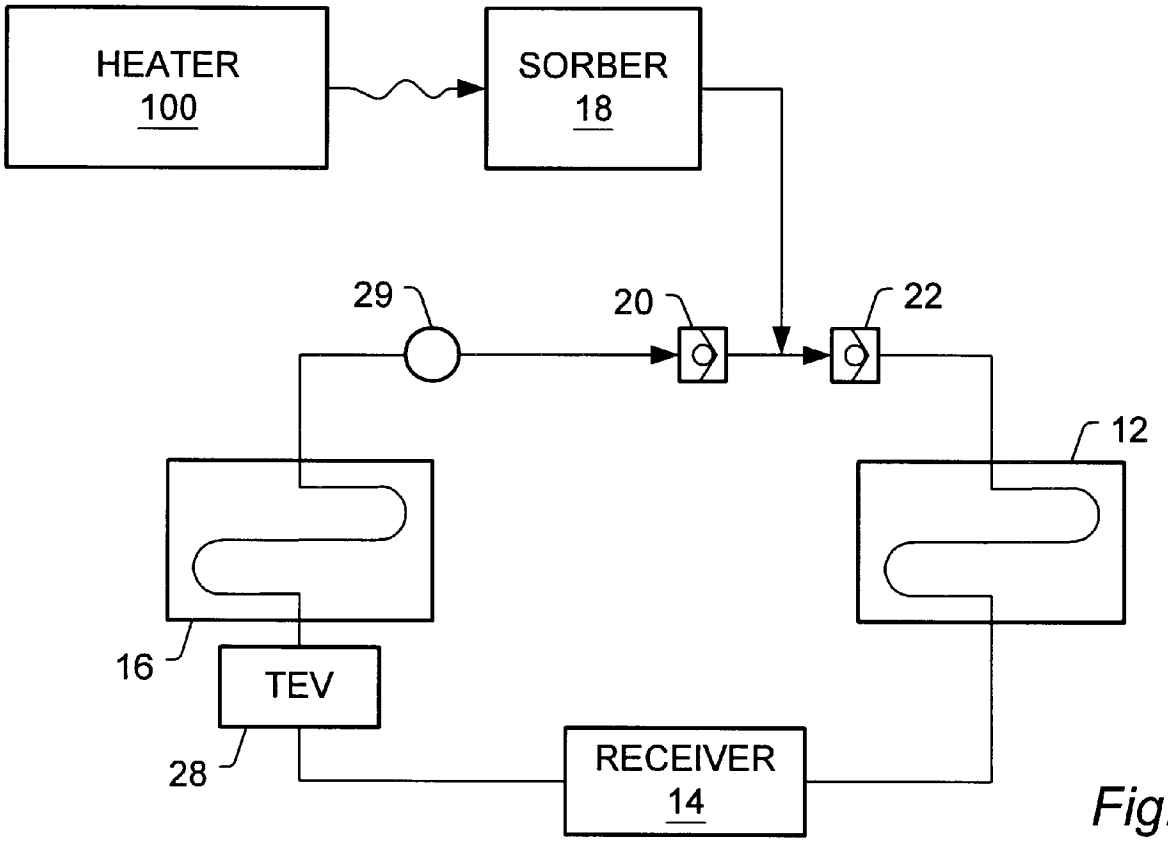
FIG. 11 is a block diagram of a sorption cooling system in accordance with one embodiment that includes a conventional heater.

This disclosure is directed to a sorber structure which can be used in a variety of sorption systems. For the sake of simplicity, however, only a preferred embodiment is described in detail below. While the preferred embodiment described below is intended for use in a system that uses electromagnetic waves to desorb the sorbate from the sorbent in a primarily non-thermal process, it should be noted that other embodiments may be designed for use in systems which vary substantially from the sorption system described below (e.g. systems which employ thermal desorption means 100, as shown in FIG. 11).

Referring to FIG. 1, a block diagram of a sorption cooling system 10 is shown. In very broad terms, a gaseous refrigerant (sorbate) is condensed to a liquid in condenser 12, collected in receiver 14 and then evaporated in evaporator 16 to produce a cooling effect. Sorber 18 collects the evaporated refrigerant during an adsorption cycle and, during a desorption cycle, produces high-pressure refrigerant gas. This high-pressure refrigerant gas is condensed by condenser 12, and the cycle repeats.

Check valves 20 and 22 maintain the flow of refrigerant in system 10 in a clockwise direction. In other words, these valves keep the refrigerant flowing from condenser 12 to receiver 14 to evaporator 16. During a desorption cycle, electromagnetic wave generator 17 produces electromagnetic waves which desorb the refrigerant from the sorbent in sorber 18. As the refrigerant is desorbed, the refrigerant pressure increases and .the refrigerant gas flows out of the sorber through conduit 24. The gas cannot flow against check valve 20 and instead flows through check valve 22 to condenser 12. As the high-pressure refrigerant gas passes through condenser 12, heat is removed and the refrigerant is condensed. The liquid refrigerant then flows into receiver 14, where it is collected. The desorption cycle continues for a predetermined period of time, during which substantially all of the refrigerant is desorbed from the sorbent.

After the desorption cycle is completed, an adsorption cycle is initiated. During the adsorption cycle, electromagnetic wave generator 17 is switched off. The liquid refrigerant collected in receiver 14 is released by thermal expansion valve 28 into evaporator 16. The refrigerant evaporates and expands in evaporator 16, cooling the evaporator and absorbing heat from the environment. The evaporated refrigerant flows through conduit 24 and is drawn into sorber 18, where it is adsorbed onto the sorbent. After substantially all of the refrigerant is adsorbed onto the sorbent, another desorption cycle is initiated. The cycle described above then repeats.

The condenser and evaporator use conventional designs. The design of condenser 12 is dependent upon factors which may vary from one embodiment to another. These factors may include the particular sorbate and sorbent used in the system, the volume of sorbate, the desired cooling capacity and others. The condenser may use fins or other means to dissipate heat, as well as other conventional design features. Because the design of the condenser is conventional and methods for designing suitable condensers are wellknown in the art, the condenser will not be discussed in further detail here. The evaporator 16 also employs a conventional design. Factors upon which the design of the evaporator depends may include the particular sorbate used in the system, the desired cooling capacity and the like. Because the suitable evaporator designs are well-known in the art, they will not be discussed in further detail here.

The evaporation of the sorbate in evaporator 16 may be controlled using thermal expansion valve 28 and pressure sensor 29. Thermal expansion valve 28 is located upstream from evaporator 16 and is configured to release sorbate into the evaporator in a controlled manner. In one embodiment, thermal expansion valve 28 is configured to release sorbate into evaporator 16 when the evaporator pressure falls below a predetermined threshold. Pressure sensor 29 is located downstream from evaporator 16 to measure the evaporator pressure. Pressure sensor 29 is configured to transmit a signal to a controller when the evaporator pressure falls below the threshold pressure. The controller in turn signals thermal expansion valve 28 to release the sorbate.

The electromagnetic wave generator used in this embodiment is a magnetron. The particular magnetron which is selected depends upon such factors as the desired operating frequency and power of the device. In other embodiments, electromagnetic wave generators such as klystrons, traveling wave tubes or solid state electromagnetic wave generators can be used. In still other embodiments, desorption means other than electromagnetic wave generators (e.g. conventional heaters 100, as shown in FIG. 11) may be used. The considerations upon which selection of a particular electromagnetic wave generator or other desorption means are based are familiar to those skilled in the art of the invention, and will not be discussed in more detail here.

In this system, electromagnetic waves are used to selectively pump energy into the bonds between the sorbate and sorbent, thereby separating the sorbate from the sorbent without substantially heating them. The system therefore has the advantage of not having to remove additional thermal energy resulting from the desorption reaction in order to condense the sorbate. In other embodiments, the energy necessary to desorb the sorbate from the sorbent may be provided by a conventional heater 100, as shown in FIG. 11. The heater 100 supplies thermal energy which stochastically heats the sorbate/sorbent compound until the bond between the sorate and sorbent are broken. This thermal energy may also be supplied by the de ice which uses electromagnetic waves (e.g., radio frequency or microwaves to heat the sorbat/sorbent compound. If the sorbate is thermally desorbed, the additional thermal energy from the desorption reaction must be removed in order to condense the sorbate.

Figure 2:
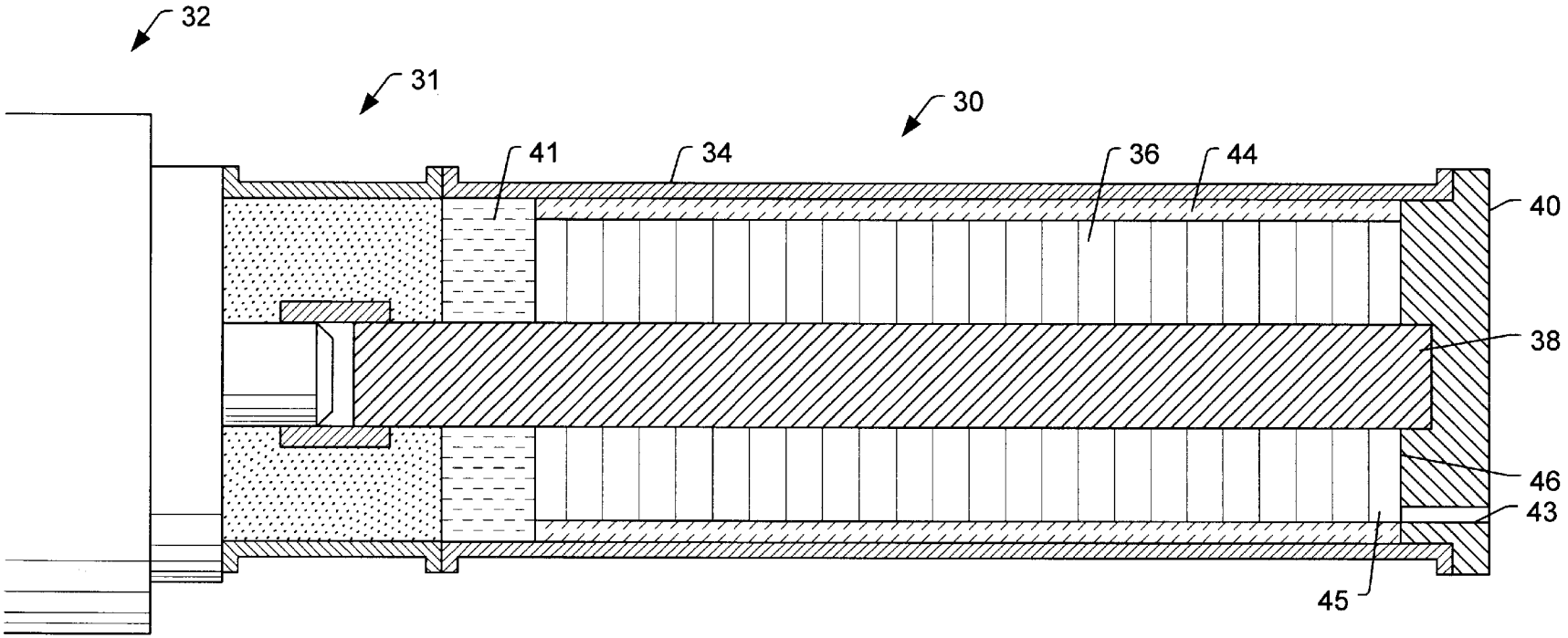
FIG. 2 is a sorber in accordance with one embodiment.

Referring to FIG. 2, the structure of a sorber 30 in one embodiment is shown. Sorber 30 is connected through a coupler 31 to an electromagnetic wave generator 32. Electromagnetic waves produced by generator 32 are directed by coupler 31 into sorber 30, where they are absorbed by the bonds of the sorbate/sorbent compound contained within the sorber. By selectively pump in energy into the bonds in this manner, the sorbate is non-thermally desorbed from the sorbent. It should be noted that other embodiments may instead use electromagnetic waves or conventional heating means 100, as shown in FIG. 11, to thermally desorb the sorbate from the sorbent.

Sorber 30 has a generally cylindrical shape, although this may vary in other embodiments. Sorber housing 34 is a tubular metallic structure which acts as an outer conductor of a coaxial transmission line for the electromagnetic waves produced by generator 32. Inner conductor 38 of the coaxial transmission line extends through end plug 41 so that the transmission line can be electrically connected to coupler 31. A metallic end cap 40 terminates the other end of the transmission line and seals the sorber enclosure. The dimensions of the sorber are determined such that the transmission line formed by housing 34, inner conductor 38 and end cap 40 is tuned to the frequency of the electromagnetic waves produced by generator 32.

The sorbent contained within sorber 30 comprises a series of disks 36. (It should be noted that, although only one of the disks is indicated by the reference numeral in the figure, there are a plurality of these disks, each of which is identical to disk 36.) The disks are stacked face-to-face to form a cylindrical mass of sorbent material. Each of the disks has a hole in its center to accommodate inner conductor 38. Each of the disks is formed with a plurality of grooves in its surface extending from near the center of the disk to its outer edges. The grooves provide a channel through which sorbate can flow to reach the interior of the sorbent mass End cap 40 has an inlet/outlet port 43 which allows the sorbate to enter and exit the sorber enclosure. Sorbate entering the sorber through port 43 encounters a first face 46 of disk 45. Face 46 has grooves therein which provide a path for the sorbate to flow radially outward toward gas path sleeve 44. Gas path sleeve 44 has grooves therein which provide paths for the sorbate to flow down the length of sorber 30 to each of the sorbent disks 36. The sorbate can then flow through the channels created by the grooves in the faces of the disks to reach the interior of the cylindrical sorbent mass. The sorbate is thereby distributed throughout the mass of sorbent comprising the disks and is absorbed more efficiently than if only the outer surface of the cylindrical mass were exposed to the sorbate.

Figure 3:
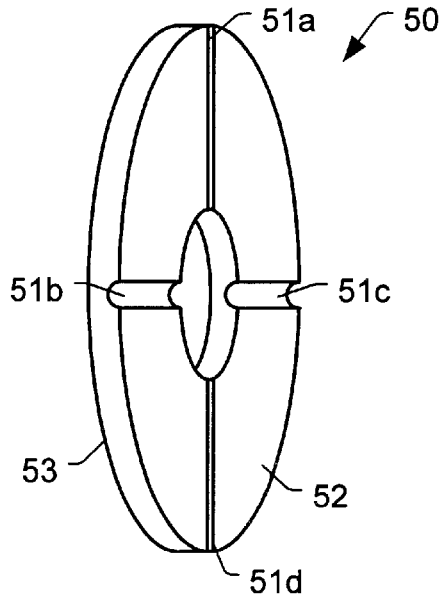
FIG. 3 is a sorbent disk in accordance with one embodiment.

Referring to FIG. 3, a single one of the sorbent disks is shown. Disk 50 is annular in shape. In this embodiment, disk 50 is formed with four grooves 51 in one face 52. The grooves extend radially from the outer perimeter of the disk to the aperture at the center of the disk. The opposite face 53 of the disk is flat. Disk 50 is formed from a solid sorbent which allows the disk to retain its shape within the sorber. Disk 50 can be formed, for example, from sintered zeolite or ceramics using conventional manufacturing techniques.

Figure 4:
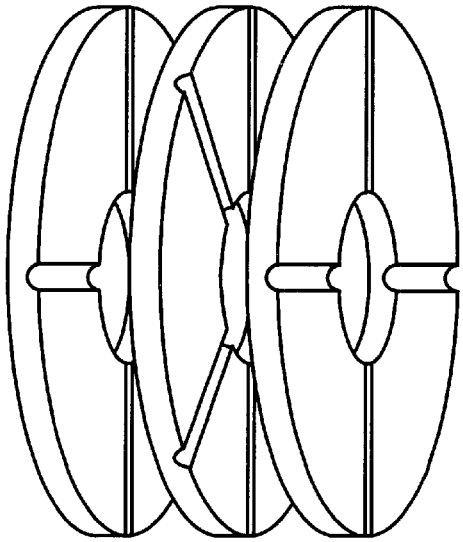
FIG. 4 is an exploded view of a partial stack of sorbent disks in accordance with one embodiment.

When a plurality of the sorbent disks are stacked together face-to-face as shown in FIG. 4, the grooves form pathways for sorbent gets to flow throughout the resulting cylindrical sorbent mass. In the illustrated embodiment, each sorbent disk has grooves in only one of its two faces. When the disks are stacked, they should all have their flat faces facing the same direction (left in the figure) in order to ensure that the grooves provide passageways between each adjacent pair of disks. The disks in the figure are also oriented with alternate disks being rotated 45 degrees in order to maximize the spacing between the grooves of adjacent disks and to thereby enable more even distribution of the sorbate throughout the sorbent mass. It may be desirable to key the disks to facilitate proper orientation of the disks and to maintain this orientation. Constructing the sorbent mass by forming grooves in the faces of the disks and then stacking them provides a more cost-efficient method for providing pathways for circulation of the sorbate than the prior art method of forming a solid cylindrical sorbent mass and drilling a plurality of holes into the sorbent mass.

Figure 5:
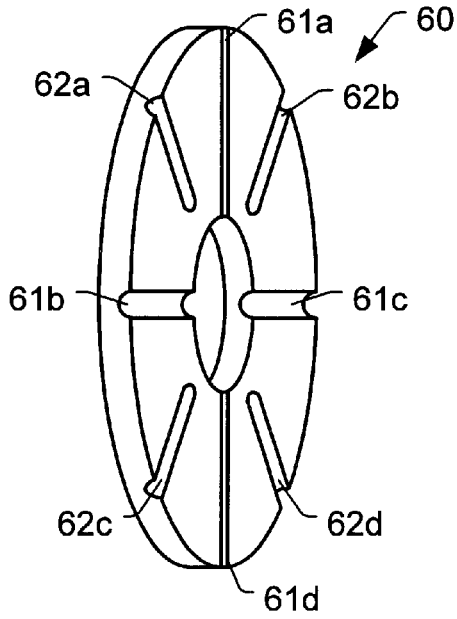
FIG. 5 is a sorbent disk in accordance with an alternate embodiment.
Figure 6:
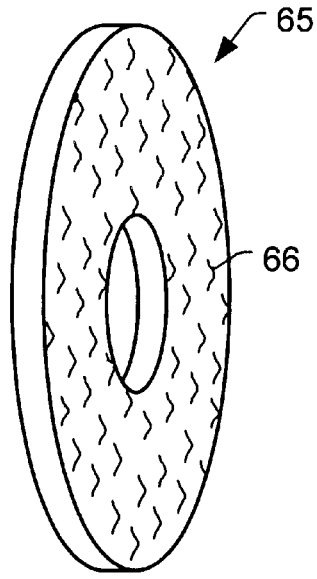
FIG. 6 is a sorbent disk in accordance with another alternate embodiment.

It should be noted that the sorbent disks illustrated in FIGS. 3 and 4 use just one of a number of configurations which are possible. For example, the grooves may have different dimensions, they may be irregular, they may be more closely spaced, they may have branches, or they may be formed on both sides of the disk. One example of a disk in a different embodiment is a shown in FIG. 5. In this embodiment, disk 60 has four equally spaced primary grooves 61 which extend from the perimeter of the disk to the central aperture of the disk. The disk also has four secondary grooves 62 which extend only part of the way from the perimeter of the disk to the central aperture of the disk. Each of the secondary grooves is evenly spaced between two of the primary grooves. The disks may also use surface features other than grooves to form pathways for circulation of sorbate through the sorbent mass. For example, as shown in FIG. 6, the disk 65 may have a plurality of small bumps 66. Bumps 66 are distributed across the surface of disk 65. When a plurality of these disks are stacked face-to-face, the bumps cause a gap to be maintained between adjacent disks. The sorbate can then flow freely through this gap, coming into contact with most of the surface area of each of the adjacent disks. Again, it should be noted that particular surface features illustrated here are exemplary and many other types of surface features may be used to achieve the same function.

Once the sorbent disks are formed, they are easily installed in the sorber housing. The disks are simply stacked and placed on the inner conductor, then this assembly is inserted into the sorber housing. Both the inner conductor and the housing can be swaged against the sorbent disks to hold the entire assembly together. Swaging the conductors against the sorbent disks creates a tight fit between the disks and conductors and ensures good thermal contact between them so that heat removal from the sorber is facilitated. The housing and inner conductor can also be swaged against the end plug and end cap to hold them in place. In other embodiments, other means may also be used to join together the components of the sorber (e.g., welding the end cap to the outer housing.)

Figure 7:
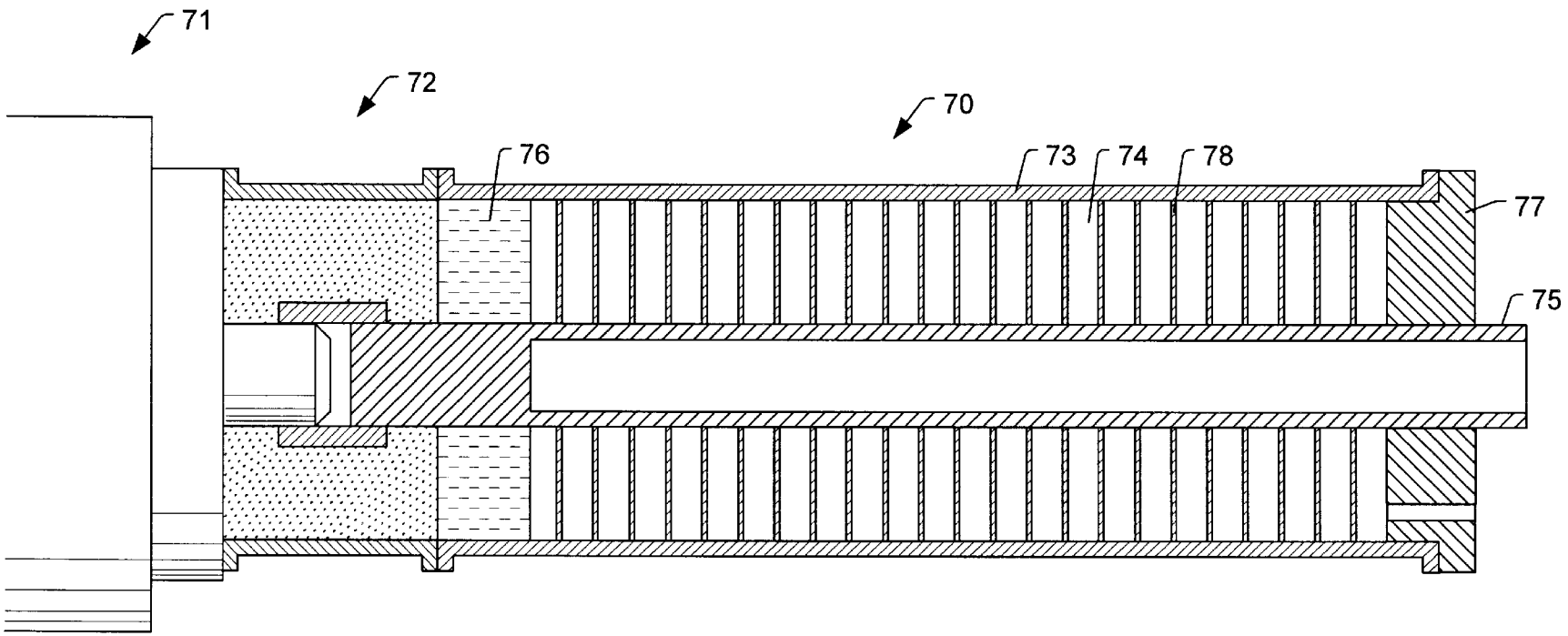
FIG. 7 is a sorber in accordance with an alternate embodiment.

Referring to FIG. 7, an alternate embodiment of a sorber is shown. Sorber 70 is coupled to electromagnetic wave generator 71 by coupler 72. Sorber 70 comprises an electrically conductive (e.g., metal) housing 73 which contains a plurality of sorbent disks 74. Sorbent disks 74 are generally annular in shape, each having a central aperture through which electrically conductive tube 75 extends. Tube 75 is coaxial with housing 73, so that these two components form a coaxial transmission line for the electromagnetic waves produced by generator 71. Sorber 70 also includes an end plug 76 and an end cap 77 which are fitted to housing 73 and inner conductor 75 to form an enclosure around sorbent disks 74. End plug 76 is formed from a material which is transparent to the electromagnetic waves produced by generator 71. End cap 77, on the other hand, is electrically conductive so that it terminates the transmission line formed by housing 73 and inner conductor 75.

Sorber 70 differs from the embodiment illustrated in FIG. 2 in that the embodiment of FIG. 7 includes a plurality of electrically conductive disks 78, each of which is located between a pair of sorbent disks 74 which are stacked face-to-face. (It should be noted that "face-to-face," as used herein, describes the general orientation of the disks and is not intended to imply that the faces of must be touching.) Conductive disks 78 are metallic and are electrically coupled to inner and outer conductors 75 and 73. More specifically, each metallic disk 78 is electrically coupled to one or the other of these conductors, but not both. This is shown in more detail in FIGS. 8 and 9.

Figure 8:
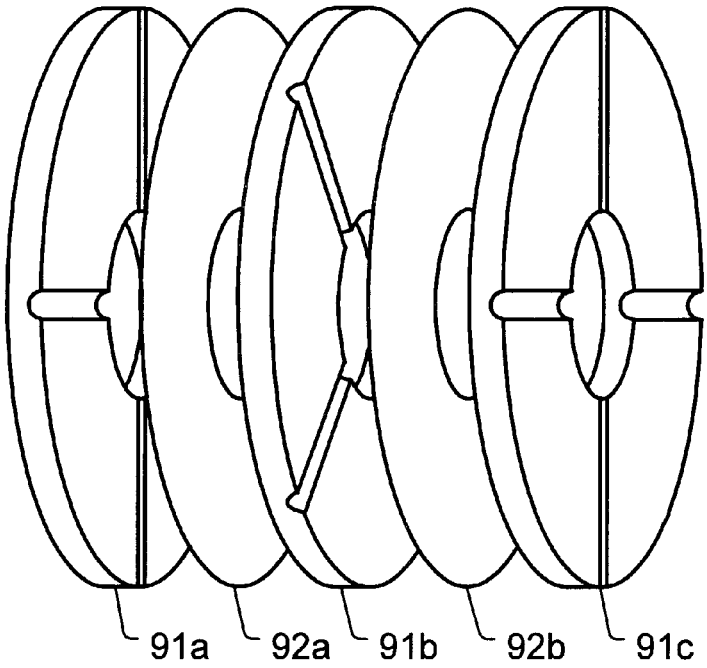
FIG. 8 is an exploded view of a partial stack of sorbent disks and metal disks in accordance with an alternate embodiment.

Referring to FIG. 8, an exploded view of the sorbent and metallic disks is shown. This figure illustrates the manner in which several of the sorbent disks 91 and metallic disks 92 are stacked. The same sorbent disks which are used in the previously described embodiment (i.e., those having four radial grooves) are used in this embodiment. Because metallic disks 92 separate adjacent sorbent disks 91, however, it may be preferable to form the sorbent disks with grooves in both sides in order to allow sorbate to be delivered to both sides of each disk rather than only one.

Figure 9:
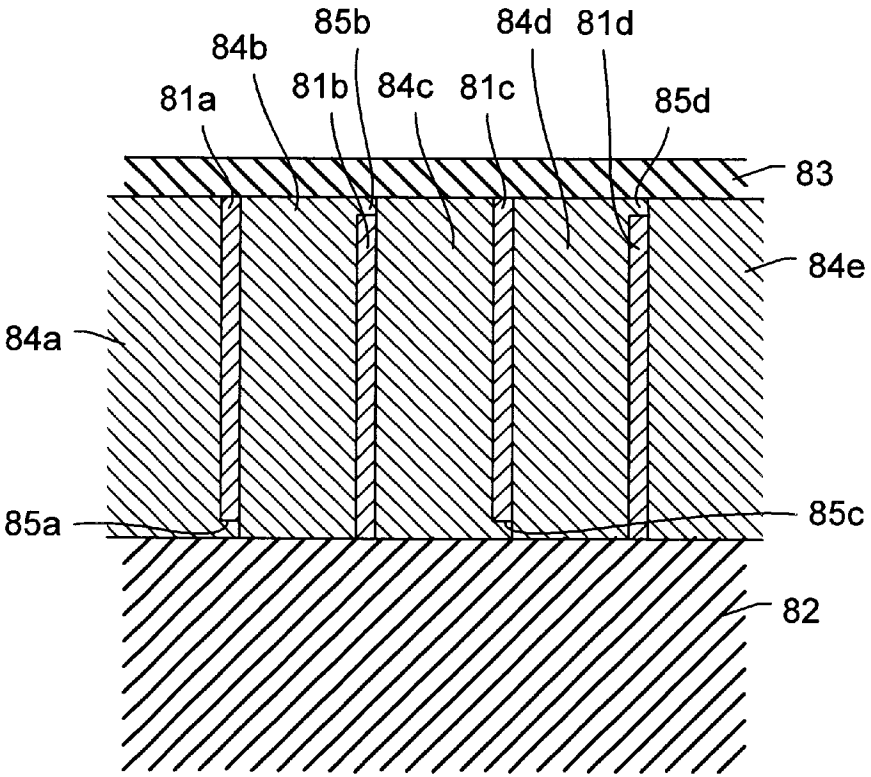
FIG. 9 is a detailed view of the sorbent disks and metal disks installed between a sorber housing and an inner conductor in one embodiment.

Referring to FIG. 9, a more detailed view of the sorber structure is shown. It can be seen from this figure that successive ones of metallic disks 81 are coupled alternately to inner conductor 82 and housing 83. This configuration is achieved by manufacturing half of the metallic disks (e.g., 81*a*) with the same outer diameter as the sorbent disks 84 and a slightly larger inner diameter than the sorbent disks. When installed between the sorbent disks, these metallic disks (e.g., 81*a*) will contact the housing and will thereby be electrically coupled to the housing. The other half of the metallic disks (e.g., 81*b*) are manufactured with the same inner diameter as sorbent disks 84, but with a slightly smaller diameter than the sorbent disks. When installed between the sorbent disks, these metallic disks (e.g., 81*b*) will contact inner conductor 82 and will thereby be electrically coupled to the inner conductor.

Because of the high electric fields which are developed between the conductors, each of sorbent disks 84 includes a small lip 85 which separates an adjacent metallic disk 81 from the one of the conductors to which it is not connected to prevent arcing between the conductor and the metallic disk. For example, lip 85*a* extends longitudinally from sorbent disk 84*a* to separate adjacent metallic disk 81*a* from inner conductor 82. Similarly, lip 85*b* of sorbent disk 84*b* separates adjacent metallic disk 81*b* from outer conductor 83. The configurations of sorbent disks 84*a* and 84*b* differ in that 84*a* has lip 85*a* adjacent to inner conductor 82, while 84*b* has lip 85*b* adjacent to outer conductor 83.

Figure 10:
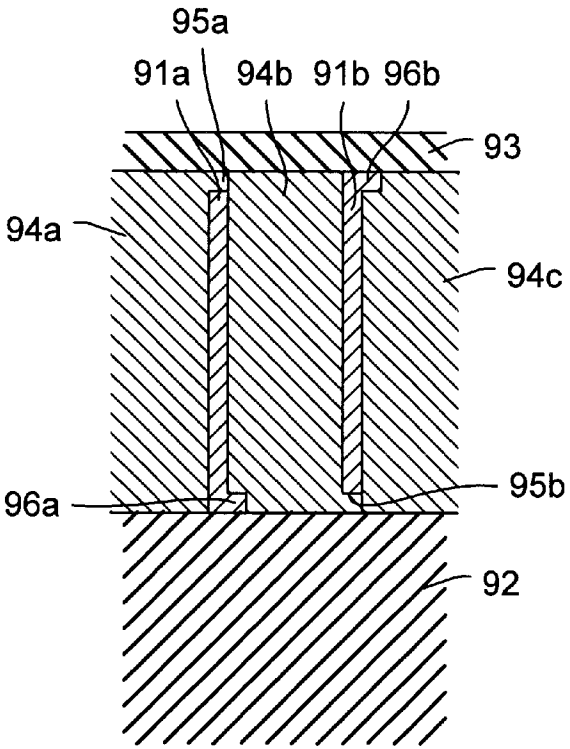
FIG. 10 is a detailed view of the configuration of sorbent disks and metallic disks in an alternate embodiment.

In another embodiment, the metallic disks may be configured to have lips adjacent to the conductors to which they are electrically coupled in order to improve the electrical and thermal contact between them. Referring to FIG. 10, the configuration of sorbent disks and metallic disks in an alternate embodiment is shown. In this embodiment, it can be seen that metallic disks 91 have lips adjacent to the conductors to which they are coupled. For example, disk 91*a* has a lip 96*a* on its inner edge. Lip 96*a* provides improved contact between disk 91*a* and inner conductor 92. Similarly, disk 91*b* has a lip 96*b* on its outer edge which provides improved contact with outer conductor 93. In this embodiment, the sorbent disks 94 have recesses or grooves which are complementary to the lips 96 of the metallic disks 91 so that the sorbent disks 94 and metallic disks 91 will fit together without having gaps between them. Sorbent disks 94 also have lips 95 to fit between the metallic disks and the conductors to which they are not coupled.

Lips 96 could easily be formed in the process of stamping the disks out of sheet metal. The disks could first be stamped to form indentations, the wall of which would form the lips. The disks could then be stamped to cut the edges of the disks, leaving the lips on the inner or outer edges, depending upon whether the disks are configured to be connected to the inner or outer conductors. As noted above, the sorbent disks should be formed with small recesses in their inner or outer edges to accommodate the lips of the metallic disks.

Placing the metallic disks between the sorbent disks serves several purposes. For example, it serves to increase the magnitude of the electric field applied across the sorbent disks. Coupling alternate ones of the metallic disks to the inner and outer conductors also serves to more evenly distribute the energy of the electromagnetic waves throughout the sorbent material. Alternately coupling the metallic disks to the inner and outer conductors also provides more even distribution of the electromagnetic energy than coupling all of the disks to either the inner conductor or the outer conductor alone.

Placing the metallic disks in contact with the inner conductor and housing further serves to provide improved heat transfer in the sorber. Since the refrigerant is more readily adsorbed onto the sorbent when the sorbent is cool, it is important to remove excess heat built up in the sorber during the desorption cycle. The metallic disks provide a heat transfer path from the center of the sorbent mass to the housing and inner conductor, which can then transfer this heat to the environment. It should be noted that since the inner conductor is tubular, coolant can be circulated in the conductor to improve the efficiency of the heat removal. Although not shown in FIGS. 9 and 10, cooling fins or other mechanisms may be incorporated into the housing to further improve the efficiency of heat removal from the sorber.

It should be noted that, in this embodiment, because some of the metal disks are configured to make contact with the housing of the sorber, the gas path sleeve used in the previous embodiment to distribute sorbate along the length of the sorber cannot be used. Some provision should therefore be made to allow the sorbate to flow along the length of the sorber. This may be achieved in a number of ways, such as by providing perforations in the metallic disks, or by providing grooves in the inner surface of the housing itself.

While the present invention has been described with reference to particular embodiments, it will be understood that the embodiments are illustrative and that the invention scope is not limited to these embodiments. Many variations, modifications, additions and improvements to the embodiments described are possible. These variations, modifications, additions and improvements may fall within the scope of the invention as detailed within the following claims.

What is claimed is:

1. A sorber comprising:

a plurality of disks of a sorbent material, wherein each said disk has one or more surface features, wherein said plurality of disks are disposed in stacked relation to form a sorbent mass, and wherein said surface features form a plurality of passageways between an outer surface of said sorbent mass and an interior of said sorbent mass; and a housing which forms an enclosure around said sorbent mass, wherein said housing has one or more ports configured to enable sorbate to flow into said housing and out of said housing.

2. The sorber of claim 1 wherein said surface features comprise a plurality of radial grooves which extend from the periphery of said each disk to an interior portion of said each disk.

3. The sorber of claim 1 wherein said sorbent material comprises zeolite.

4. The sorber of claim 1 wherein said sorbent material comprises a ceramic.

5. The sorber of claim 1 wherein said sorber is configured to be coupled to an electromagnetic wave generator.

6. The sorber of claim 5 wherein the sorber further comprises one or more conductors configured to form a waveguide, wherein said waveguide is configured to direct said electromagnetic waves generated by said electromagnetic wave generator onto said sorbent mass.

7. The sorber of claim 6 wherein said one or more conductors comprise said housing and an inner conductor.

8. The sorber of claim 7 further comprising a plurality of metal disks, wherein each of said metal disks is disposed between an adjacent pair of said sorbent disks.

9. The sorber of claim 8 wherein each of said metal disks is electrically coupled to one of said conductors.

10. The sorber of claim 9 wherein each of said metal disks further comprises a lip extending longitudinally from said each metal disk, wherein said lip is configured to contact said one of said conductors to which said each metal disk is electrically coupled.

11. The sorber of claim 9 wherein said metal disks are alternately coupled to said housing and said inner conductor.

12. The sorber of claim 11 wherein said metal disks are generally annular in shape, each having an aperture therethrough, wherein ones of said metal disks which are coupled to said housing have an enlarged aperture to avoid contact with said inner conductor, wherein ones of said metal disks which are coupled to said inner conductor have a decreased outer diameter to avoid contact with said housing, and wherein each of said sorbent disks has a lip configured to extend between an adjacent one of said metal disks and one of said housing and said inner conductor.

13. The sorber of claim 1 configured to be heated by a conventional heater during a desorption cycle.

14. A cooling system comprising:

a condenser configured to condense a gaseous sorbate to a liquid state;

an evaporator configured to receive said liquid sorbate and to evaporate said liquid sorbate to create a cooling effect; and a sorber coupled to said condenser to adsorb said evaporated sorbate, wherein said sorber is configured to desorb said sorbate and wherein said sorber is coupled to said evaporator and to convey said sorbate to said condenser;

wherein said sorber contains a mass of sorbent and wherein said sorbent comprises a plurality of disks stacked face-to-face, each said disk having a plurality of grooves formed in at least one face thereof, wherein when said plurality of disks is stacked said plurality of grooves form a plurality of passageways from an outer surface of said mass of sorbent to an interior of said mass of sorbent.

15. A method comprising:

providing a plurality of disks of a sorbent material, wherein each said disk has one or more surface features;

stacking said plurality of sorbent disks face-to-face, wherein said surface features in each said sorbent disk form a plurality of passageways between said sorbent disks;

enclosing said stacked sorbent disks in a sorber housing; and sealing said sorber enclosure.

16. The method of claim 15 wherein providing said sorbent disks comprises forming zeolite in a desired shape and sintering said zeolite.

17. The method of claim 15 wherein providing said sorbent disks comprises forming radial grooves in said sorbent material.

18. The method of claim 15 further comprising swaging said sorber enclosure against said sorbent disks after said sorbent disks are enclosed in said housing.

19. The method of claim 15 wherein said housing comprises an outer conductor, the method further comprising providing an inner conductor and positioning said inner conductor in an aperture extending through each of said sorbent disks.

20. The method of claim 18 wherein stacking said plurality of sorbent disks face-to-face comprises placing each of a plurality of metal disks between an adjacent pair of said sorbent disks, wherein each of said metal disks is placed in contact with one of said conductors.

21. The method of claim 20 further comprising:

forming each of said metal disks with a lip adjacent to said one of said conductors with which said each metal disk is in contact;

forming each of said sorbent disks with a lip configured to be positioned between an adjacent one of said metal disks and said one of said conductors with which said each metal disk is in not contact when said sorbent disks and said metal disks are stacked.

22. A sorber comprising:

a plurality of members each of said members comprising a sorbent material, and having one or more surface features, wherein said plurality of members are disposed in stacked relation to form a sorbent mass, and wherein said surface features form a plurality of passageways between an outer surface of said sorbent mass and an interior of said sorbent mass; and a housing which forms an enclosure around said sorbent mass, wherein said housing has one or more ports configured to enable sorbate to flow into said housing and out of said housing.

23. The sorber of claim 22, wherein said surface features comprise a plurality of radial grooves which extend from the periphery of said each member to an interior portion of said each member.

24. The sorber of claim 22, wherein said sorbent material comprises zeolite.

25. The sorbet of claim 22, wherein said sorbent material comprises a ceramic.

26. The sorber of claim 22, wherein said sorber is configured to be coupled to an electromagnetic wave generator.

27. The sorber of claim 26, wherein the sorber further comprises one or more conductors configured to form a waveguide, wherein save waveguide is configured to direct said electromagnetic waves generated by said electromagnetic wave generator onto said sorbent mass.

28. The sorber of claim 27, wherein said one or more conductors comprise said housing and an inner conductor.

29. The sorber of claim 28, further comprising a plurality of metal members, wherein each of said members is disposed between an adjacent pair of said sorbent members.

30. The sorber of claim 29, wherein each of said metal members is electrically coupled to one of said conductors.

31. The sorber of claim 30, wherein each of said metal members further comprises a lip extending longitudinally from said each metal member, wherein said lip is configured to contact said one of said conductors to which said each metal member is electrically coupled.

32. The sorber of claim 30, wherein said metal members are alternately coupled to said housing and said inner conductor.

33. The sorber of claim 32, wherein said metal members having an aperture therethrough, wherein ones of said metal members which are coupled to said housing have an enlarged aperture to avoid contact with said inner conductor, wherein ones of said metal members which are coupled to said inner conductor have a decreased perimeter to avoid contact with said housing, and wherein each of said sorbent members has a lip configured to extend between an adjacent one of said members and one of said housing and said inner conductor.

34. The sorber of claim 22, configured to be heated by a conventional heater during a desorption cycle.

35. A cooling system comprising:

a condenser configured to condense a gaseous sorbate to a liquid state;

an evaporator configured to receive said liquid sorbate and to evaporate said liquid sorbate to create a cooling effect; and a sorber coupled to said condensor to adsorb said evaporated sorbate, wherein said sorber is configured to desorb said sorbate and wherein said sorber is coupled to said evaporator and to convey said sorbate to said condenser;

wherein said sorber contains a mass of sorbent and wherein said mass of sorbent comprises a plurality of members stacked face-to-face, each said member having a plurality of surface features formed in at least one face thereof, wherein when said plurality of members is stacked said plurality of surface features form a plurality of passageways from an outer surface of said mass of sorbent to an interior of said mass of sorbent.

36. A method comprising:

providing a plurality of members of a sorbent material, wherein each said member has one or more surface features;

stacking said plurality of sorbent members face-to-face, wherein said surface features in each said sorbent member form a plurality of passageways between said sorbent members;

enclosing said stacked sorbent members in a sorber housing; and sealing said sorber enclosure.

37. The method of claim 36, wherein providing said sorbent members comprises forming zeolite in a desired shape and sintering said zeolite.

38. The method of claim 36, wherein providing said sorbent members comprises forming radial grooves in said sorbent material.

39. The method of claim 36, further comprising swaging said sorber enclosure against said sorbent members after said sorbent members are enclosed in said housing.

40. The method of claim 36, wherein said housing comprises an outer conductor, the method further comprising providing an inner conductor and positioning said inner conductor in an aperture extending through each of said sorbent members.

41. The method of claim 39, wherein stacking said plurality of sorbent members face-to-face comprises placing each of a plurality of metal members between an adjacent pair of said sorbent members, wherein each of said metal members is placed in contact with one of said conductors.

42. The method of claim 41, further comprising:

forming each of said metal members with a lip adjacent to said one of said conductors with which said each metal member is in contact;

forming each of said sorbent members with a lip configured to be positioned between an adjacent one of said metal members and said one of said conductors with which said each metal member is in not contact when said sorbent members and said metal members are stacked.

* * * * *